US009646788B2

(12) United States Patent
Parks et al.

(10) Patent No.: US 9,646,788 B2
(45) Date of Patent: May 9, 2017

(54) ELECTRICAL PYROTECHNIC SWITCH

(71) Applicant: Autoliv Development AB, Vargarda (SE)

(72) Inventors: Brent Parks, Castle Rock, CO (US); Amina Hamida, Saint-Martin Longueau (FR); Patrice Boutin, Taverny (FR); Alain Magne, Andresy (FR)

(73) Assignee: AUTOLIV DEVELOPMENT AB, Vargarda (SE)

( * ) Notice: Subject to any disclaimer, the term of this patent is extended or adjusted under 35 U.S.C. 154(b) by 0 days.

(21) Appl. No.: 14/431,364

(22) PCT Filed: Sep. 28, 2012

(86) PCT No.: PCT/EP2012/069225
§ 371 (c)(1),
(2) Date: Mar. 26, 2015

(87) PCT Pub. No.: WO2014/048495
PCT Pub. Date: Apr. 3, 2014

(65) Prior Publication Data
US 2015/0248979 A1 Sep. 3, 2015

(51) Int. Cl.
*H01H 39/00* (2006.01)

(52) U.S. Cl.
CPC ..... *H01H 39/004* (2013.01)

(58) Field of Classification Search
CPC .. H01H 1/00; H01H 1/21; H01H 1/24; H01H 1/42; H01H 1/44; H01H 1/46; H01H 1/48;
(Continued)

(56) References Cited

U.S. PATENT DOCUMENTS 2,891,134 A * 6/1959 Ramrath ..... H01H 1/42 200/260
3,793,501 A 2/1974 Stonestrom
(Continued)

FOREIGN PATENT DOCUMENTS

DE 10254497 B3 6/2004
DE 102011113955 A1 3/2012
WO WO-2011/064510 A1 6/2011

OTHER PUBLICATIONS

International Search Report for PCT/EP2012/069225, ISA/EP, mailed Jun. 18, 2013.

*Primary Examiner* — Anthony R. Jimenez
(74) *Attorney, Agent, or Firm* — Stephen T. Olson; Harness, Dickey & Pierce, P.L.C.

(57) ABSTRACT

An electrical switch includes a first conductive terminal having a first contact portion, a second conductive terminal having a second contact portion, and a moveable body moveable from a first position, in which the first and second contact portions are electrically disconnected, to a second position, in which the first and second contact portions are electrically connected. The first and second contact surfaces are cylinders parallel to respectively the first and second contact portions, such that the second contact surface freely goes through the first contact portion, the first contact surface enters in connection with the first contact portion simultaneously to the moment when the second contact surface enters in connection with the second contact portion, and at least one of the first and second surfaces and the corresponding one of the first and second contact portions are arranged so that the moveable body is maintained in the second position.

19 Claims, 1 Drawing Sheet

(58) Field of Classification Search
CPC ..... H01H 85/00; H01H 15/06; H01H 1/38; H01H 1/385; H01H 1/40; H01H 39/00; H01H 39/002; H01H 39/004; H01H 2233/09
USPC ..... 200/61.08, 540, 541
See application file for complete search history.

(56) References Cited

U.S. PATENT DOCUMENTS

| | | | | |
|---|---|---|---|---|
| 9,099,268 | B2 * | 8/2015 | Oberg | H01H 39/004 |
| 2003/0231452 | A1 | 12/2003 | Hetzmannseder et al. | |
| 2013/0126326 | A1 | 5/2013 | Borg | |

* cited by examiner

ELECTRICAL PYROTECHNIC SWITCH

CROSS REFERENCE TO RELATED APPLICATIONS

This application is a 371 U.S. National Stage of International Application No. PCT/EP2012/069225, filed on Sep. 28, 2012, the entire disclosure of which is incorporated herein by reference.

FIELD

The present invention relates to an electrical switch, and particularly to an electrical switch controlled by a pyrotechnic device to actuate it.

BACKGROUND

The document WO 2011/064510 A1 describes an electrical switch actuated by a pyrotechnic device. One of the disclosed embodiments is a switch comprising three conductive terminals, and a sliding body may move from a first position, in which two of these terminals are disconnected, to a second position, in which these two terminals are electrically connected. However, the movement of the slider requires an important force, as the slider in the first position connects one of these two terminals to the third one. An important force is required to cut this initial connection. This important effort either may cause functioning issues if the pyrotechnic device is not supplying enough energy to push the slider, or will necessitate a powerful and expensive pyrotechnic device to ensure a reliable functioning. Moreover, the slider is guided by an outer female part and also presents biased surfaces, to maintain the connecting position. The tolerances of manufacturing of these numerous parts are thus of an extreme importance to ensure the reliability of the functioning. Added to the complexity of shapes described in this design, the disclosed switch is expensive. It may also be noted that the biased surfaces do not provide a correct contact interface between the slider and the conductive terminals, so that this switch is not suitable for being used to shunt terminals being subjected to high intensity currents. Indeed, the biased surface of the slider will contact the terminal trough a line or a reduced surface, and any high intensity current will create electric arcs or will heat the material located at the contact line, with a high risk of fire, or bad or lack of connection.

SUMMARY

The present invention aims to solve these aforementioned drawbacks and is directed to propose first a switch suitable to close an electrical circuit subjected to high intensity current, but simple to manufacture and presenting a reliable functioning.

With this goal in mind, a first aspect of the invention is an electrical switch comprising:

- a first conductive terminal comprising a first contact portion,
- a second conductive terminal comprising a second contact portion,
- a moveable body with a first and second contact surfaces arranged on an electric conductive portion, and moveable from a first position, in which the first and second contact portions are electrically disconnected, to a second position, in which the first and second contact portions are electrically connected respectively by the first and second contact surfaces,
- a combustion chamber, closed by the moveable body,
- an electrical pyrotechnic device arranged to generate pressurizing gas in the combustion chamber to move the moveable body from the first position to the second position, characterized:

- in that each of said first and second conductive terminals presents an elongated flat end portion and in that the first and second contact portions are cylindrical openings crossing a thickness of the respective elongated flat end portion of each conductive terminal,
- in that said first and second contact surfaces are cylinders parallel to respectively said first and second contact portions,
- in that said second contact surface has a length arranged so that the first contact surface enters in connection with the first contact portion simultaneously to the moment when the second contact surface enters in connection with the second contact portion,
- and in that at least one of said first and second contact surfaces and the corresponding one of the first and second contact portions are arranged so that the moveable body is maintained in the second position.

The present invention provides a switch easy to manufacture, as the contact portions of the terminals are cylindrical openings or holes. The switch presents a reliable movement of the moveable body, as the contact surfaces connect their respective contact portion simultaneously: there is no contact before the connection. The movement of the moveable body is not restricted by any of the terminals until the simultaneous connection. The connection, with the first contact portion being parallel to the first contact surface, and the second contact portion being parallel to the second contact surface is achieved through large surfaces of contact, thus enabling a high intensity to pass through these surfaces without the risk of creating electric arcs or warming the conductive materials. The switch provides also a reliable shunt between the terminals, as the moveable body is maintained in second position, and only by the contact portions and contact surfaces, meaning that no other parts of the switch participates to this function of maintaining the moveable body in the second position. This function is achieved by the contact surfaces and contact portion alone, so that the costs are reduced.

According to one embodiment, the first and second conductive terminals are arranged in a connection portion of the switch, separated from the combustion chamber by the moveable body, and the moveable body comprises sealing means arranged to prevent a contact between the pressurizing gas and the electric conductive portion of the moveable body. This embodiment of the present invention avoids any shunt between the terminals and the electrical pyrotechnic device. Indeed, the pressurizing gas generated by the pyrotechnic device may be conductive, and they may conduct electricity to the electric circuit used to fire the pyrotechnic device. In such case, the electric circuit used to fire the pyrotechnic device, subjected to the electric current of the conductive terminals would be damaged. Insulating the pressurizing gas from the conductive portion of the moveable body limits this risk.

According to one embodiment, said at least one of said first and second contact surfaces and the corresponding one of the first and second contact portions are arranged so that they provide a press fit assembly.

According to one embodiment, said at least one of said first and second contact surfaces and the corresponding one of the first and second contact portions are arranged so that they provide a snap fit assembly.

According to one embodiment, at least one of said first and second contact surfaces present a circular cross section.

According to one embodiment, at least one of said first and second contact surfaces present a rectangular cross section.

According to one embodiment, the moveable body is comprising:

an electric conductive part comprising the electric conductive portion and an electric insulating part closing the combustion chamber.

This embodiment provides part easy to manufacture, before being assembled to form the moveable body.

According to one embodiment, the electric insulating part is molded over the electric conductive part. This embodiment reduces the amount of operations on the assembly line of the switch.

Alternatively, the electric insulating part is a coating deposited onto the electric conductive part.

According to one embodiment, the electric conductive part is metallic and manufactured with a cold forming process.

According to one embodiment, the electric conductive part material is copper.

According to one embodiment, the sealing means are arranged on the electric insulating part.

According to one embodiment, the moveable body is arranged in a guiding hole to move from the first position to the second position, and the sealing means are at least one lip arranged between the electric insulating part and the guiding hole.

According to one embodiment, the first and second conductive terminals present different geometries, so that mixing them at the assembly of the switch is not possible. These differentiating geometries avoid that the terminal with the smallest contact portion is mounted in the place of the other terminal, because this would cause the moveable body to abut the smallest contact portion without connecting the other contact portion.

According to one embodiment, the first and second conductive terminals are manufactured with a drawing process.

According to one embodiment, the electrical switch comprises a main body, the first and second conductive terminals are positioned in the main body, and the main body is arranged so that the first and second conductive terminals are moveable relatively to the main body in order to allow a self alignment of the first and second contact portions with the moveable body when it moves from the first position to the second position.

According to one embodiment, the first and second conductive terminals are molded in the main body.

In addition or alternatively, the first and second conductive terminals may be deformable to achieve this self alignment function.

According to one embodiment, said first contact portion presents a greater cross section than said second contact portion, so that during the movement of the moveable body from the first to the second position, the second contact surface freely goes through the first contact portion.

The switch presents a reliable movement of the moveable body, as when the moveable body moves from the first position to the second position, its second contact surfaces freely goes through the first conductive terminal. In other words the moveable body goes trough the first terminal, without any contact, so that friction is significantly reduced, and there is no force to withstand due to contacts between the moveable body and the first conductive terminal.

According to one embodiment, said moveable body comprises at least one cross section smaller than the first contact portion, so that during the movement of the moveable body from the first to the second position, the moveable body freely goes through the first contact portion.

The moveable body goes trough the first terminal, without any contact, so that friction is significantly reduced, and there is no force to withstand due to contacts between the moveable body and the first conductive terminal.

The invention is also related to a use, in an electrical switch, of sealing means between a combustion chamber and a connection portion to avoid an electrical connection by an electric arc between pressurizing gas in the combustion chamber and a conductive terminal arranged in the connection portion, the electrical switch comprising:

a first conductive terminal arranged in the connection portion, a second conductive terminal arranged in the connection portion, a moveable body, moveable from a first position wherein the first and second conductive terminals are disconnected to a second position wherein the first and second conductive terminals are electrically connected by a conductive portion of the moveable body, electrical pyrotechnic device, arranged to generate pressurizing gas in the combustion chamber to move the movable body from the first position to the second position.

DESCRIPTION OF THE DRAWINGS

Other characteristics and advantages of the present invention will appear more clearly from the following detailed description of particular non-limitative examples of the invention, illustrated by the appended drawings where.

DETAILED DESCRIPTION

Figure 1:
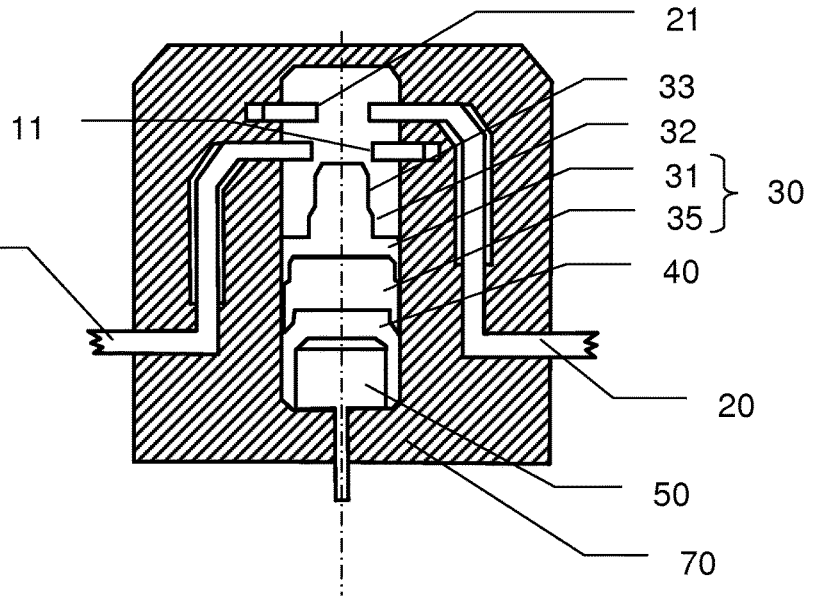
FIG. 1 represents a switch according to the present invention, with the moveable body in the first position.

The electrical switch represented at FIG. 1 comprises:

a first conductive terminal 10 with a first cylindrical contact portion 11, a second conductive terminal 20 comprising a second cylindrical contact portion 21, a moveable body 30 with a first cylindrical contact surface 32 and second contact surface 33 arranged on an electric conductive portion 31, a combustion chamber 40, closed by the moveable body 30, an electrical pyrotechnic device 50 arranged to create pressurizing gas in the combustion chamber 40, the moveable body 30 being made of two parts, a conductive portion 31 and an insulating part 35.

The first contact portion 11 presents a greater cross section than the second contact portion 21, and accordingly, the first contact surface 32 presents a greater cross section than the second contact surface 33. This arrangement ensures that the first contact portion 11 does not contact the second contact surface 33.

All the conductive parts may be manufactured in copper, to achieve low electric resistance. In addition, these conductive parts may be coated with silver in the area where the mechanical contacts occur to enhance the conductance at these contact area.

The electric switch presents a main body 70 made of Polyphthalamide (PPA) with glass fiber to achieve the necessary mechanical resistance and the correct electric insulation.

As represented on FIG. 1, the first conductive terminal 10 is not electrically connected to the second conductive terminal 20. If there is a need to shunt the first and second conductive terminals 10, 20, the electrical pyrotechnic device 50 is ignited, so that it will generate pressurizing gasses in the combustion chamber 40, and under this increased pressure, the moveable body 30 will move from the first position represented FIG. 1 to a second position, as represented FIG. 2.

Figure 2:
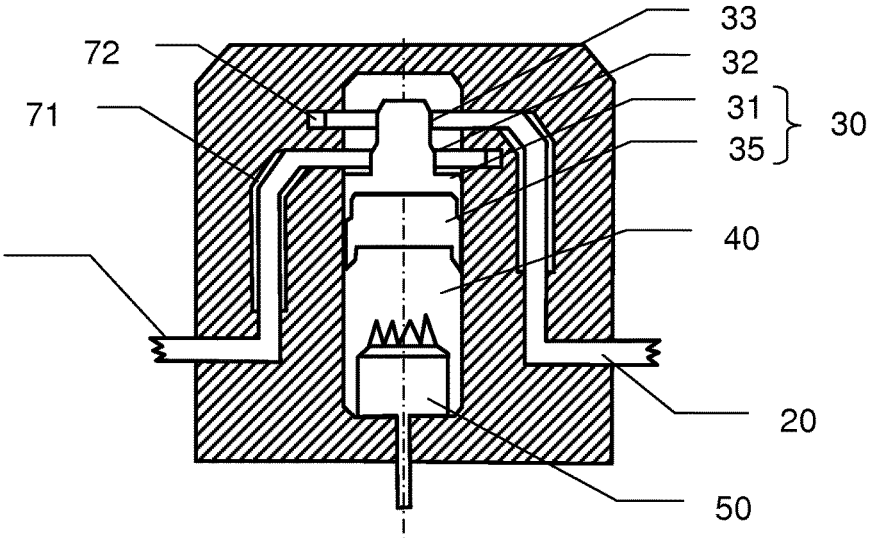
FIG. 2 represents the switch of FIG. 1 with the moveable body moved to the second position.

On FIG. 2, the electrical pyrotechnic device 50 has been ignited by an ignition current, to pressurize the combustion chamber 40. Pushed by this pressure, the moveable body 30 has moved to the second position where the first conductive terminal 10 is electrically connected to the second conductive terminal 20. This is achieved by the first contact portion 11 being in contact with the first contact surface 32, and by the second contact portion 21 being in contact with the second contact surface 33. Since the second contact surface 33 has a smaller diameter than the first contact portion 11, there was no friction between these two surfaces during movement of the moveable body 30.

It is important to notice that the first and second conductive terminals 10 and 20 shall not being mixed at the assembly, as the first contact portion 11 is larger than the second contact portion 21. In this aim, the first conductive terminal 10 is not identical/symmetrical with the second conductive terminal 20. It is not possible, due to the difference of geometry between the terminals, to mix them at the assembly.

The reliability of the functioning is ensured, as the length of the second contact surface 33 is arranged so that the first contact surface 32 enters in connection with the first contact portion 11 simultaneously to the moment when the second contact surface 33 enters in connection with the second contact portion 21.

The first contact surface 32 and the first contact portion 11 are arranged to present a press fit assembly when the moveable body 30 is in the second position, to maintain the connection between the two terminals 10 and 20. Alternatively or in addition, the second contact surface 33 and the second contact portion 21 may similarly be arranged to present a press fit assembly when the moveable body 30 is in the second position. The shunt between the two terminals is maintained and there is no risk of unexpected disconnection. Under these conditions, currents up to 5000 Amperes may flow in this electrical switch, during 1 second and up to 600 Amperes, during 60 seconds.

The main body 70 comprises hollow spaces 71, 72 around the first and second conductive terminals 10, 20. These free spaces allow the first and second conductive terminals 10, 20 to move, in order to provide a self alignment capacity of the first and second contact portions 11, 21 with the first and second contact surfaces 32, 33 when the moveable body 30 moves from the first position to the second position. In addition or alternatively, the first and second conductive terminals 10, 20 may be arranged to deform themselves to allow the self alignment, with a reduced cross section, or holes to locally weaken the first and second conductive terminals 10, 20.

Another aspect is that the first and second contact portions 11, 21, and the first and second contact surfaces 32, 33 are cylindrical and parallel, resulting in good contacts when the moveable body 30 is in the second position. Areas of contact are important, as the parts present surface-surface contact. High current intensity may pass through those surfaces, without the risk of creating electric arc or warming up to melting the conductive material due to high resistance of contact.

Figure 3:
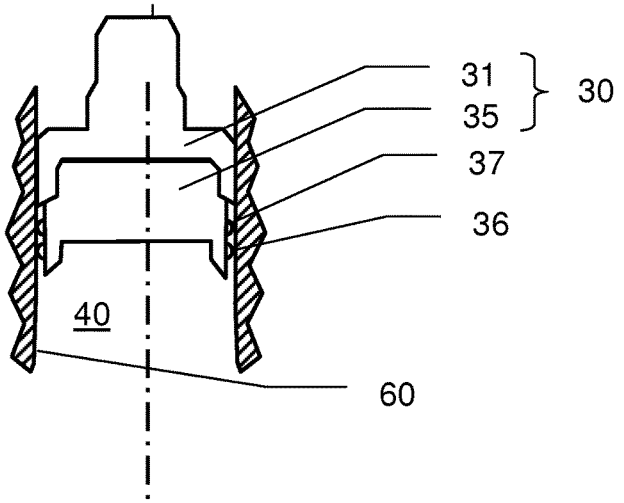
FIG. 3 represents a detail of the moveable body of FIG. 1.

FIG. 3 represents a detail of the insulating part 35. The moveable body 30 is guided by a hollow surface 60, and is located between the conductive terminals 10, 20, and the combustion chamber 40. When the electrical pyrotechnic device 50 is ignited, it generates pressurizing gasses, hot and electrically conductive. To avoid the creation of an electrical path between the conductive terminals 10, 20 and the electric circuit of the electrical pyrotechnic device 50, it is necessary to insulate the pressurizing gasses from the electric conductive portion 31. In this aim, the insulating part 35 comprises sealing lips 36, 37 surrounding it, and arranged between the insulated part 35 and the guiding surface 60. It results that the pressurizing gasses generated by the electrical pyrotechnic device 50 cannot pass between the guiding surface 60 and the insulated part 35, thus the creation of an electric arc in the pressurizing gasses, between the electric conductive portion 31 and the electric circuit of the electrical pyrotechnic device 50 is avoided. The electronic control unit which controls the ignition of the electrical pyrotechnic device 50 is protected against the risk of being damaged by the high intensity current coming from the conductive terminals 10, 20.

It is understood that obvious improvements and/or modifications for one skilled in the art may be implemented, being under the scope of the invention as it is defined by the appended claims.

What is claimed is:

1. An electrical switch comprising:

a first conductive terminal having a first contact portion;

a second conductive terminal having a second contact portion;

a moveable body with first and second contact surfaces arranged on an electric conductive portion, the moveable body moveable from a first position in which the first and second contact portions are electrically disconnected, to a second position in which the first and second contact portions are electrically connected by the first and second contact surfaces, respectively;

a combustion chamber closed by the moveable body; and an electrical pyrotechnic device arranged to generate pressurizing gas in the combustion chamber to move the moveable body from the first position to the second position;

wherein the first and second conductive terminals both present an elongated flat end portion and the first and second contact portions are cylindrical openings crossing a thickness of the respective elongated flat end portion of each conductive terminal, wherein the first and second contact surfaces are cylinders parallel to the first and second contact portions, respectively, wherein the second contact surface has a length arranged so that the first contact surface enters in connection with the first contact portion simultaneously to the moment when the second contact surface enters in connection with the second contact portion, and wherein at least one of first and second contact surfaces and the corresponding one of the first and second contact portions are arranged so that the moveable body is maintained in the second position.

2. The electrical switch according to claim 1, wherein at least one of the first and second contact surfaces and the corresponding one of the first and second contact portions are arranged to provide a press fit assembly.

3. The electrical switch according to claim 1, wherein at least one of the first and second contact surfaces and the corresponding one of the first and second contact portions are arranged to provide a snap fit assembly.

4. The electrical switch according to claim 1, wherein at least one of the first and second contact surfaces present a circular cross section.

5. The electrical switch according to claim 1, wherein the first contact portion presents a greater cross section than said second contact portion, so that during the movement of the moveable body from the first to the second position, the second contact surface freely goes through the first contact portion.

6. The electrical switch according to claim 1, wherein the moveable body comprises at least one cross section smaller than the first contact portion, so that during the movement of the moveable body from the first to the second position, the moveable body freely goes through the first contact portion.

7. The electrical switch according to claim 1, wherein the second contact surface has a constant diameter along the length.

8. The electrical switch according to claim 1, wherein:

the first and second conductive terminals are separated from the combustion chamber by the moveable body, and the moveable body comprises sealing means arranged to prevent a contact between the pressurizing gas and the electric conductive portion of the moveable body.

9. The electrical switch according to claim 8, wherein the moveable body comprises:

an electric conductive part comprising the electric conductive portion; and an electric insulating part closing the combustion chamber, and the sealing means are arranged on the electric insulating part.

10. The electrical switch according to claim 9, wherein the moveable body is arranged in a guiding hole to move from the first position to the second position, the sealing means includes at least one lip arranged between the electric insulating part and the guiding hole.

11. The electrical switch according to claim 1, wherein the moveable body comprises:

an electric conductive part comprising the electric conductive portion; and an electric insulating part closing the combustion chamber.

12. The electrical switch according to claim 11, wherein the electric insulating part is molded over the electric conductive part.

13. The electrical switch according to claim 11, wherein the electric insulating part is a coating deposited onto the electric conductive part.

14. The electrical switch according to claim 11, wherein the electric conductive part is metallic and manufactured with a cold forming process.

15. The electrical switch according to claim 11, wherein the electric conductive part material is copper.

16. The electrical switch according to claim 1, wherein the electrical switch includes a main body, the first and second conductive terminals are positioned in the main body, and the main body is arranged so that the first and second conductive terminals are moveable relatively to the main body in order to allow a self alignment of the first and second contact portions with the moveable body when it moves from the first position to the second position.

17. The electrical switch according to claim 16, wherein the first and second conductive terminals are molded in the main body.

18. A method of controlling an electrical switch having a first conductive terminal with a first contact portion and a second conductive terminal with a second contact portion, the method comprising:

providing a moveable body having an electric conductive portion with first and second cylindrical contact surfaces; and moving the moveable body with a pressurized gas generated by a pyrotechnic device from a first position wherein the first and second conductive terminals are disconnected to a second position wherein the first and second conductive terminals are electrically connected by a conductive portion of the moveable body by contacting the first cylindrical contact surface with the first contact portion and the second cylindrical contact surface with the second contact portion, wherein the first contact surface enters in connection with the first contact portion simultaneously to when the second contact surface enters in connection with the second contact portion.

19. The method according to claim 18, wherein at least one of first and second contact surfaces and the corresponding one of the first and second contact portions are arranged so that the moveable body is maintained in the second position.

* * * * *